US008842129B2

(12) United States Patent
Verbeque et al.

(10) Patent No.: US 8,842,129 B2
(45) Date of Patent: Sep. 23, 2014

(54) DEVICE AND METHOD FOR GENERATING VARIABLE PRIORITY MULTIWINDOW IMAGES

(75) Inventors: Jean-René Verbeque, Saint Aubin de Medoc (FR); Nicolas Levasseur, Cestas (FR); Yannick Benaben Portarrieu, Gradignan (FR)

(73) Assignee: Thales, Neuilly sur Seine (FR)

( * ) Notice: Subject to any disclaimer, the term of this patent is extended or adjusted under 35 U.S.C. 154(b) by 213 days.

(21) Appl. No.: 13/220,469

(22) Filed: Aug. 29, 2011

(65) Prior Publication Data

US 2012/0050320 A1 Mar. 1, 2012

(30) Foreign Application Priority Data

Aug. 31, 2010 (FR) ..... 10 03482

(51) Int. Cl.
*G09G 5/02* (2006.01)
*G09G 5/14* (2006.01)

(52) U.S. Cl.
CPC ..... *G09G 5/14* (2013.01); *G09G 2340/12* (2013.01); *G09G 2340/10* (2013.01); *G09G 2380/12* (2013.01)
USPC ..... 345/592

(58) Field of Classification Search
CPC ..... G02B 2027/0112; G02B 2027/014; G09G 2310/0235; G09G 3/3607; G09G 5/02; G09G 2310/02; G09G 3/3611; G06T 15/005; G06T 15/405; H04N 19/00151; H04N 19/0026; H04N 19/00454; H04N 19/00509; H04N 19/0066; H04N 19/00678; H04N 19/00684; H04N 19/00781
USPC ..... 345/592
See application file for complete search history.

(56) References Cited

U.S. PATENT DOCUMENTS

| | | | | |
|---|---|---|---|---|
| 6,870,538 | B2 * | 3/2005 | MacInnis et al. | 345/505 |
| 7,084,871 | B2 | 8/2006 | Jardin et al. | |
| 7,158,152 | B2 | 1/2007 | Jardin et al. | |
| 7,168,048 | B1 * | 1/2007 | Goossen et al. | 715/797 |
| 2002/0171682 | A1 * | 11/2002 | Frank et al. | 345/790 |
| 2004/0156560 | A1 | 8/2004 | Verbeque | |
| 2004/0210390 | A1 | 10/2004 | Jardin | |
| 2010/0079489 | A1 | 4/2010 | Cheng et al. | |
| 2011/0018886 | A1 | 1/2011 | Levasseur et al. | |

FOREIGN PATENT DOCUMENTS

| | | | |
|---|---|---|---|
| FR | 2925206 | A1 | 6/2009 |
| WO | 2009/081650 | A1 | 7/2009 |

OTHER PUBLICATIONS

Preliminary Search Report for French Patent App. No. 10/03482, 2011.

* cited by examiner

*Primary Examiner* — Kee M Tung
*Assistant Examiner* — Haixia Du
(74) *Attorney, Agent, or Firm* — Baker & Hostetler LLP

(57) ABSTRACT

Techniques for generating images with information windows including variable display priorities, the technique including selecting pixels of active windows at a given area of the image and reconstituting an image on the basis of the pixels of the selected windows. The techniques ensure mixing of the pixels and transparency between windows. The techniques apply to aircraft flight displays and any other image generating devices.

9 Claims, 3 Drawing Sheets

§

DEVICE AND METHOD FOR GENERATING VARIABLE PRIORITY MULTIWINDOW IMAGES

CROSS-REFERENCE TO RELATED APPLICATIONS

This application claims priority to foreign French patent application No. FR 10 03482, filed on Aug. 31, 2010, the disclosure of which is incorporated by reference in its entirety.

FIELD OF THE INVENTION

The field of the invention relates to graphical generation devices and methods and more particularly to the display mechanisms necessary for managing complex images composed of several windows with variable priority and mixing of contents.

BACKGROUND OF THE INVENTION

In the field of aeronautics, aircraft flight displays present a piloting symbology which is increasingly often enriched with other synthetic images such as cartographic images (MAP) or with synthetic vision images (SVS) situated either under this symbology or in adjacent surfaces, the surface available on current displays allowing this function. More generally the images of flight displays may also be composed of multiple windows that can have different refresh rates, variable positionings and sizes and that need if necessary to be mixed together in accordance with a particular order, which may change however. These images also comprise elements created by software tasks having different criticality levels.

There exist screen controllers that may or may not be integrated with graphical generation functions which ensure a form of hardware support for the functionalities offered by software of operating systems, however although the latter ensure the display of surfaces created off-screen, none exist that do so while ensuring automatic sorting and variable mixing, nor which are able to control cursor generators and video mixers. Quite often moreover the support for windowing is ensured by software in a mode which is akin to a selection of all or nothing type between surfaces, only recent operating systems for the mass market include functions for mixing between superimposed surfaces but this is purely for aesthetic purposes or at best as a memory aid since the content of the lower surfaces is most often made unreadable by the introduction of blurring.

There exist automatons allowing image composition at the pixel level but management of priority is performed globally at the window level. Mixing with management of transparency sometimes has hardware support but is most often done in a non real-time software manner. The number of constituent surfaces of an image is limited by the size of the associated hardware.

The objective of the invention is to propose a method for generating images making it possible to improve the management of the images with multiple windows having a variable display priority, the aim being to increase the flexibility of management of the windows and to reduce the bandwidth required for the video stream.

SUMMARY OF THE INVENTION

More precisely, the invention is a device for generating an image comprising a plurality of information windows that can be displayed superimposed, the said image consisting of mixed pixels whose value is composed of a mixture of n superimposed layers of intermediate pixels from among m layers, an information window being supported by a layer of intermediate pixels and being parametrized by a window descriptor, the positioning of an information window being variable in the image surface-wise and depth-wise among the superimposed layers, the intermediate pixels being recorded in an image memory. It advantageously comprises:

- a first means for selecting n intermediate pixels belonging to n active windows from among the plurality of windows for each mixed pixel of the said image to be generated and for recording at least the following parameters arising from a window descriptor for each intermediate pixel selected: the layer identifier, the attribute and the value of the memory address within the image memory,
- a second means for generating a list of commands for access to at least one memory area of the image memory for a segment of selected intermediate pixels, the memory addresses of the said pixels being contiguous and the lists of commands addressing discontinuous image memory addresses,
- a third means for recording n composite lines of intermediate pixels, a composite line consisting of a plurality of segments of selected intermediate pixels originating from distinct layers of pixels of the image memory,
- a fourth means for mixing the values of n selected intermediate pixels originating from the said lines of pixels.

Advantageously, the means for selecting n intermediate pixels comprises as selection criterion the opacity coefficient of the intermediate pixels of the upper layers.

Advantageously, the size of the segment of selected intermediate pixels is a multiple of the size for reading image memory data in burst mode.

Advantageously, the number n of intermediate pixels selected is configurable.

Advantageously, the number m of superimposed layers is configurable.

Advantageously, the first, second, third and fourth means are implemented in a circuit of FPGA type or circuit of ASIC type.

The invention also relates to the method for generating an image implementing the device according to any one of the preceding claims. It comprises the following steps:

- A first step of selecting the intermediate pixels of the active windows from among the m superimposed layers,
- A second step of storing the parameters of selected: intermediate pixels the layer identifier, the attribute and the value of the memory address in the memory of the image,
- A third step of generating an access command for a segment of selected intermediate pixels,
- A fourth step of recording a list of access commands for segments of pixels constituting a line of intermediate pixels.
- A fifth step of recording a line of selected intermediate pixels which consists of a plurality of the said segments of pixels, the said line comprising intermediate pixels originating from distinct layers of pixels.
- A sixth step of mixing the pixels of the said recorded lines for the composition of the mixed pixels of the image.

Advantageously, the access command line is an access in burst mode.

Advantageously, in the first step, the intermediate pixels of the active windows positioned on a layer lower than an intermediate pixel having a maximum opacity coefficient are not selected.

The present invention makes it possible to relieve the software almost entirely of the low-level tasks since all these operations are supported by the hardware resources in real time, it allows the composition of complex images and also the driving of a cursor generator as well as that of a video mixer situated downstream.

The invention is also aimed at optimizing the use of the bandwidth of the image memory or memories in which the surfaces to be viewed are created, and accordingly it makes it possible to associate with the descriptor specific to the surface a concept of opacity which is not interpreted solely in colorimetric terms but also as an indication that it is not necessary to fetch the graphical elements of the underlying surfaces.

Furthermore, the image memories can equally well be organized as single or dual page memories and can resort to one or two physical memory banks so as to be able to address a range of products with unequal performance.

One of the significant benefits of this invention is to compose the image on the fly and thus to introduce only a very low latency in addition to the calculation which will have to have been done in order to generate each surface, this also makes it possible to minimize the hardware resources required in order to carry out the function.

BRIEF DESCRIPTION OF THE DRAWINGS

The invention will be better understood and other advantages will become apparent on reading the nonlimiting description which follows and by virtue of the appended figures among which.

DETAILED DESCRIPTION

The device according to the invention makes it possible to improve the process for generating images having the feature of comprising several windows with variable criticality and display parameters. The windows may be moved, displayed in transparency and moved depth-wise by varying the display priority. The invention is particularly advantageous in respect of aircraft cockpit viewing device images. Indeed, for aeronautical applications, flight displays present windows displaying critical flight information which must be secure whereas other information for navigation support is accessory. The critical information is generally simple and displayed on a uniform background so as to favour reliability of display. The non-paramount navigation support information may be complex images and exhibit a lower reliability level.

Figure 1:
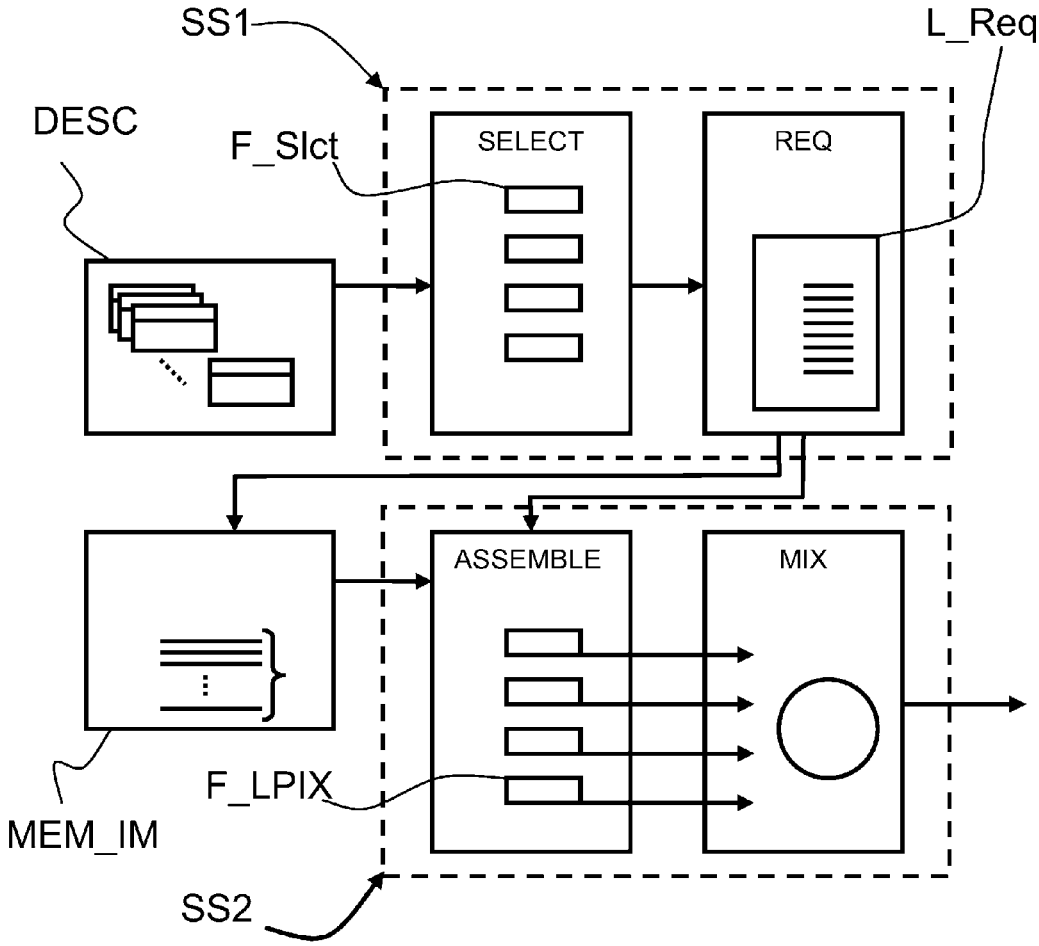
FIG. 1 is a diagram representing the major functional means of the device for generating images.

As illustrated by FIG. 1, the device exhibits schematically two functional subsets.

A first subset SS1 is a function for managing windows which utilizes the descriptors to sort and order the windows and which by virtue of these data generates requests for access to the image memory.

A second subset SS2 is a function for collecting the pixels in the image memory MEM_IM so as to reconstruct the image with a reduced number of layers of intermediate pixels. This subset also ensures the mixing of the pixels of the reconstructed lines of pixels.

The current embodiment of these entities makes it possible to configure both the number of windows and the number of layers as well as the number of physical image memory MEM_IM. The description which follows implements sixteen windows, a mixer MIX with four levels and an image memory MEM_IM using two memory banks. This embodiment must be considered to be an example since other combinations are possible, depending on requirements.

Figure 2:
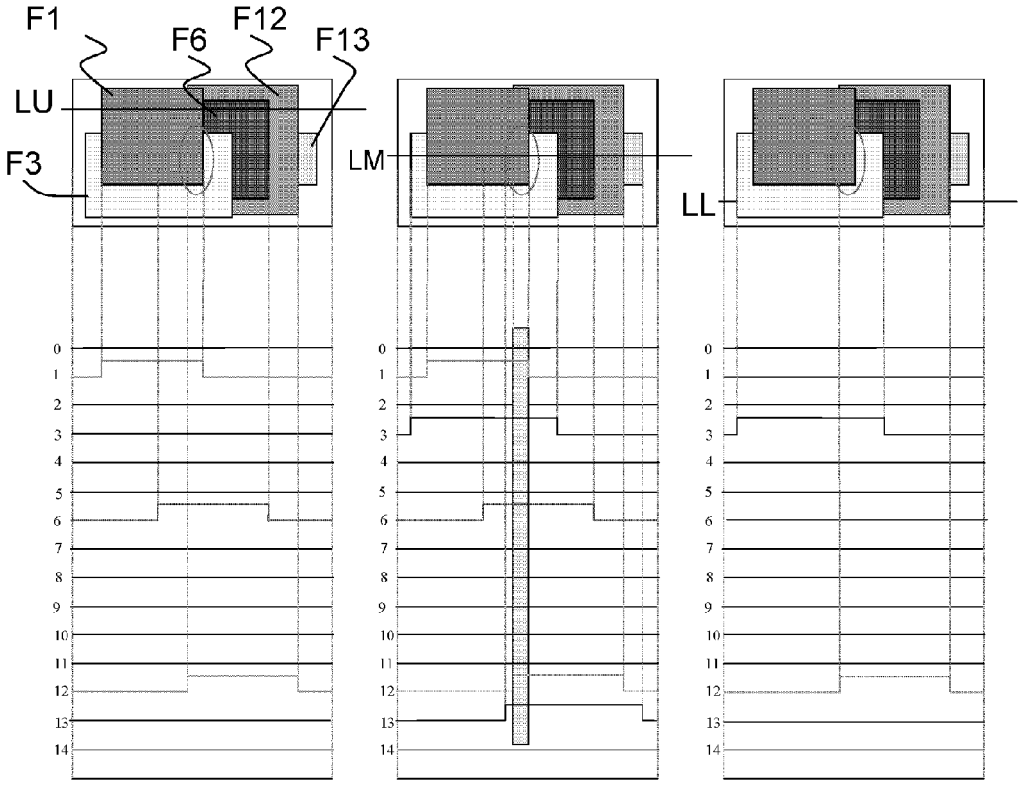
FIG. 2 an image displayed on a viewing device. This diagram illustrates the method for selecting the active pixels according to three distinct lines of pixels in the image.

FIG. 2 represents an exemplary schematic image comprising five superimposed information windows F1, F3, F6, F12, F13 ordered display-wise so that the window F1 is in the foreground plane, the window F3 on a lower plane than the window F1 and therefore covered by the window F1 to the eyes of the operator who is observing the window. The following windows are ordered according to the same law of priority, the numbers indicating the order of priority. During the use of the viewing device, the order of priority of the windows can vary. This priority parameter is indicated in a window descriptor comprising other information. The order of priority is defined by the level of the layer of pixels making up the image. The image consists of mixed pixels whose value is composed of a mixture of n superimposed layers of intermediate pixels from among m layers. An information window is supported by a layer of intermediate pixels. The intermediate pixels being recorded in an image memory.

In this example, sixteen layers of pixels are possible. The image consists of lines of pixels staged from top to bottom in the image. The windows participate in the composition of the lines of pixels and each line is composed differently as a function of the position of the windows in the space of the image. In FIG. 2, the line LU positioned in the top part of the image is composed by three active windows, the windows F1, F6 and F12. The line LM is composed by five active windows, the windows F1, F3, F6, F12 and F13. The line LL is composed by two windows, the windows F3 and F12. The active windows can exhibit a variable opacity coefficient rendering them transparent or completely opaque. This opacity coefficient parameter is also indicated in a window descriptor comprising other information.

The window descriptors DESC are provided in the form of an array of values which furnish the position in memory, the address, of the first pixel of the surface, by convention and as is often the case in matrix-type image generation, it is the upper left corner, but any other origin would change nothing. The coordinates (u,v) of the first visible pixel of the surface and its position (x,y) on the screen are also provided, the description of the viewing area is supplemented with the provision of the screen coordinates of the last visible pixel, with the previous convention it is therefore the lower right corner.

However, an additional parameter is necessary, this being the horizontal pitch of the surface to be viewed, that is to say the memory size allocated to the description of a line of the image, stated otherwise the amount by which the memory address must be increased in order to pass to the following line. For reasons concerned with a desire to make the parameters uniform, a size expressed in pixels is used here.

An ancillary word furnishes parameters such as:

Choice of the active cursor(s) in the surface, the example given here is limited to three, Choice of the active video in the surface, the example given here is limited to one out of three, Choice of the mixing palette, the example given here is limited to one out of sixteen, Choice of the background or erasure colour, the example given here uses an ARGB coding in the 4565 format.

An exemplary coding is given hereinbelow.

| 31 | 30 | 29 | 28 | 27 . . . 24 | 23 . . . 20 | 20 . . . 16 | 15 . . . 11 | 11 . . . 5 | 4 . . . 0 |
|---|---|---|---|---|---|---|---|---|---|
| Discretes | | | | | | Defcol | | | |
| Wactive | Opacity | Filter | Vidsel | Priority/ Identifier | Alpha table | Alpha value | Red value | Green value | Blue value |

The number of available layers limits the number of windows that can work together for the formulation of a particular pixel, this does not limit the number of windows that can be active on the entire screen.

These descriptors DESC are stored in a dual page memory, preferably a dual-port memory accessible on the one hand by the software running on the host processor and on the other hand may be copied periodically, at the rate of the vertical synchronization of the viewing device, into work registers. This copy operation is exploited to sort the surfaces as a function of their priority which is coded in the Priority field, the surfaces for which the Wactive bit is not set are ignored.

For security-critical applications, the memory may be triplicated and it is the result of a majority vote which is used for the formulation of the work table.

This table is ordered as a function of the chosen priority and does not reflect the order of storage of the descriptors in the input area.

This sorting operation can also be done by software, in this case it is imperative that the descriptors be arranged in order.

The device comprises a first means SELECT for selecting the n intermediate pixels belonging to n active windows from among the plurality of windows for each mixed pixel of the image to be generated. The image generation method comprises a first step which consists in formulating, in a manner consistent with the scanning of the screen, the time windows for which the sorted surfaces are active.

This operation is conducted in parallel on all the available descriptors DESC and produces for each usable position of the screen a status word having as many bits as manipulatable surfaces (sixteen in the example), an active bit indicating that the surface considered is active on this position and must therefore participate in the ensuing selection operation. A word is calculated per clock cycle. The frequency is not necessarily the actual frequency of display of the pixels but it is of at least equal frequency so as to guarantee the correct on-the-fly operation of the whole assembly.

In this word the position of a bit is directly related to the priority and that on account of the early elimination of the globally inactive surfaces there may be fewer bits used than usable surfaces.

The words generated are stored in a small dual page memory, a register of FIFO type could also be suitable. These words are thereafter used to allocate a surface element to a channel of the mixer, this allocation is done while taking account of the priority of the surface and of the occupancy of the channels, it is therefore basically dynamic since it is formulated in real time for each position of the screen.

The process is performed again in a concurrent manner for all the surfaces, in the exemplary application given here the concurrence is managed in a manner which is both strictly parallel and also serial through the use of a pipeline so as to minimize the hardware resources required, the priority which is, it will be recalled, deduced from the rank of the activity bit ensures that the first n surfaces will be allocated on the n channels of the mixer. If for a given position there are more than n surfaces in competition then those of higher rank than n are ignored at this location.

The function of the first means SELECT is also to record at least the following parameters arising from a window descriptor DESC for each intermediate pixel selected: the layer identifier, the attribute and the value of the memory address within the image memory. In parallel with the selection mechanism and independently of its result, the source address of the current intermediate pixel of all the active surfaces in the image memory is calculated and each time that a surface is selected its address is stored in a shift register. There is one register per useable channel.

The result of the selection of the surface or surfaces participating in the composition of the mixed pixel of the image takes account of the chosen priority but also utilizes the descriptor's opacity bit, if it is set to 1 and the surface is active then the entirety of the lower levels becomes non-available. As soon as the N layers have been allocated the allocation mechanism no longer produces anything, however the duration of the process is preserved, thereby guaranteeing constant execution time whatever the actual configuration of the windows. Selection is totally dynamic and is continuously adapted to the resources available. At the output of this stage, there are n pairs of registers F_SLCT (4 pairs are represented in the example of FIG. 1), a first register of a pair containing the identifier and the attributes of the surface to which the intermediate pixel belongs and the second register containing the address of the said intermediate pixel.

The registers F_SLCT are utilized to group together if possible the individual pixels into blocks consistent with the nature and the structure of the memory bank or banks MEM_IM used as image memory. Memories of DDR ("Dual Data Rate") type being the dominant technology today and having chosen to store contiguous pixels horizontally at contiguous addresses in memory, the use of the latter will be optimized by collecting all the pixels that can be read by means of burst-mode access, which is the normal mode of access for this type of memory.

The function of a second means REQ is to generate the commands for access to the image memory. A list of commands for access (or access requests) L_Req to at least one memory area of the image memory MEM_IM for a segment of selected intermediate pixels is created.

Figure 3:
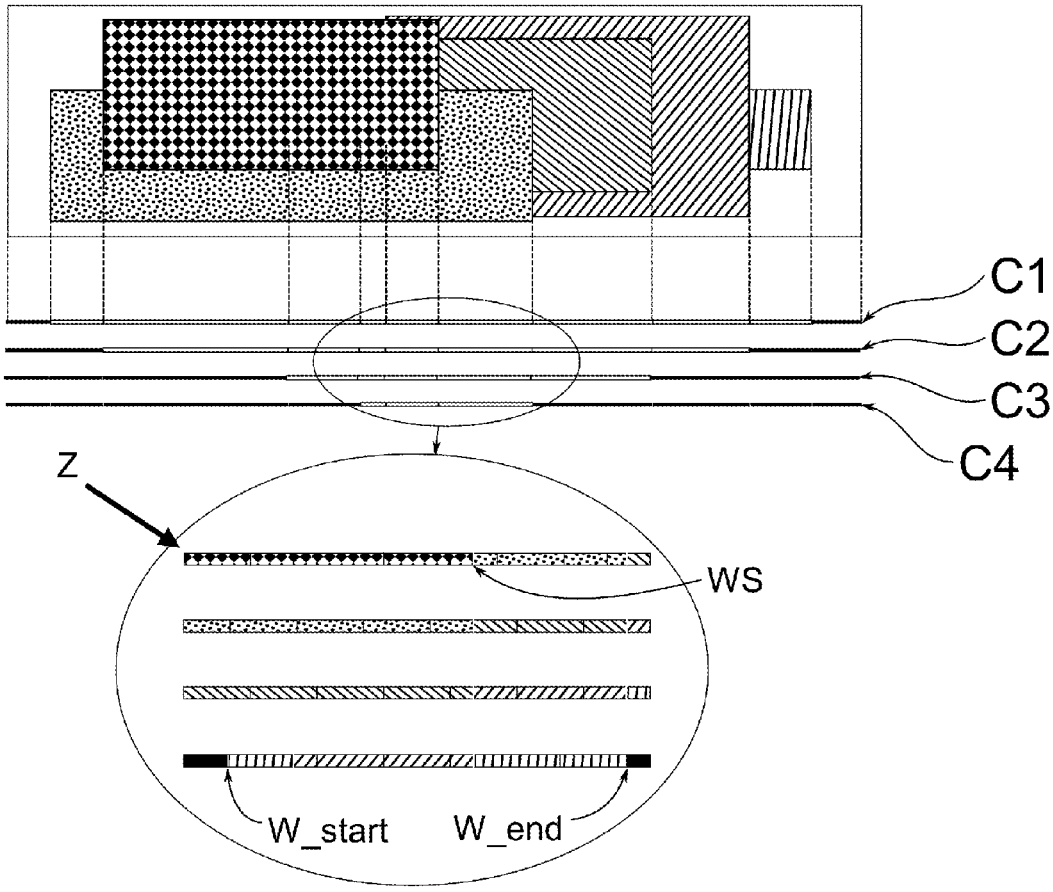
FIG. 3 is a diagram representing the mechanism for segmenting the lines of pixels of the layers making up an image.

According to a nonlimiting exemplary embodiment, the width of the memory bus and the coding chosen for the pixels are such that memory burst access allows the reading of eight consecutive pixels. This second means REQ for generating the access commands groups the pixels together eight by eight and provides the memory controller with, as address, an address aligned with the boundaries of the burst access. This address is the address of the leftmost pixel of the segment of eight pixels. As illustrated by FIG. 3, the changes of layer WS and the surface extrema W_end or W_start may be detected, in this case the request generated is most often for a number of pixels less than eight or, more generally, than the current size of the segment.

In addition to providing the address of the segment requested, the position that it will have to occupy on the screen and the size actually used are calculated. This whole set of information is grouped together in a control word which is written to a register of FIFO type, it is the degree of fill of this FIFO which regulates the selection process situated upstream. Under normal circumstances a potential request is produced every eight clock ticks.

FIG. 3 represents an image composed by the intermediate pixels selected on a level of four layers. Directly beneath are represented the lines of four layers of intermediate pixels C1, C2, C3 and C4 making up a line of mixed pixels of the image. Lower down in the figure, in an enlarged view Z, a part of each of the four lines C1 to C4 is represented so as to view the details down to the pixel.

Each of the channels of the selection mechanism possesses its own register. The final stage of the first subset polls the state of each of the FIFOs so as to generate the requests to the image memory or memories MEM_IM. With four layers, it is possible to produce a request every two clock ticks.

At this juncture of the method for generating the image, the image consisting of the four layers is not recorded as is in a memory. The content of a line is totally destructured both by the existence of paths having different latencies and by the arbitration mechanism which monitors the polling of the output FIFOs of the selection means SELECT and which therefore mixes the segments originating from distinct windows F1, F3, F6, F12 and F13 recorded in the image memory area MEM_IM at distinct addresses.

The second subset SS2 is a function for collecting the pixels in the image memory MEM_IM so as to reconstruct the image with a reduced number of layers of intermediate pixels. This subset also ensures the mixing of the pixels of the reconstructed lines of pixels.

A particular method of data display may be used to optimize the display phase. The use of this method is not compulsory. It is described in the patent application published on 19 Jun. 2009 with the publication number FR 2925206. This method of data display makes it possible, through the interrogation of an ancillary memory having a smaller size than that used by the image memory, since the unit therein is no longer the pixel but a tile grouping together several pixels, here 4×4 and a very short access time, to know whether or not this small surface has been modified and whether therefore there is cause to generate a request to the image memory MEM_IM.

The ASSEMBLE function collects by means of a first FIFO the parameters associated with the segments for which none of the pixels have been modified by the graphical unit. Two other FIFOs manage the modified segments, one stores the parameters of the segment, the other stores the data originating from the memory, given the format of the memory data this FIFO is double the size of those used for the commands.

The state of the FIFOs storing the control words L_Req is polled permanently by an automaton whose aim is to sort the segment stream as a function of the layer to which it belongs, this operation is also exploited to finalize the content of the segment as a function of the state of the modification flags.

The sorting/demultiplexing operation will therefore steer commands and data towards as many FIFOs F_LPIX as there are layers to be mixed, the steering rate is constant and requires 2 clock periods, this corresponding to the duration of a data packet.

The means necessary for the reconstruction of the lines constituting the image is architectured around multiport memories embodied here by means of pairs of dual-port memories which are used much more commonly. But a four-port memory could also be used.

The memories swap role at the line rate, while one is used by the assembly mechanism, the other is read out and feeds the mixer and is erased so as to prepare the next cycle.

The four levels of pixels selected are processed in parallel and when the end of the current line occurs the active memories on this line contain the colorimetric values of the intermediate pixels originating from distinct layers which are then transmitted to the pixel mixing means MIX. FIG. 3 represents the lines such as they may be recorded in the registers destined for the mixing function. The layers C1 to C4 are recorded in a memory with the values of intermediate pixels originating from distinct windows at successive addresses. Layer C1 is composed of values of intermediate pixels originating from five distinct windows F1, F3, F6, F12, F13. Layer C2 is composed of values of intermediate pixels originating from four distinct windows F3, F6, F12, F13. Layer C3 is composed of values of intermediate pixels originating from three distinct windows F6, F12, F13. Layer C3 is composed of values of intermediate pixels originating from two distinct windows F12, F13. The values of the other pixels of the line are recorded with a default value, which generally corresponds to the desired background value for the display.

Reading is also performed in parallel but, so as to compensate for the latency of the mixing function MIX, it starts firstly for the layer of lower level and then after a few clock cycle it propagates to the level situated above and so on. As soon as a value has been read, it is erased, the erasure value is that which will have been chosen as default colour of the screen for the lowest level and the value zero for the other levels, the ARGB colorimetric coding used considering the value zero to be a transparent (A=0) black (R=G=B=0).

The data of the ASSEMBLE function are dispatched to the corresponding inputs of the function of the mixer MIX. The latter uses a plurality of adders-multipliers to carry out the mixing operations, the latter are performed in an iterative manner between a background element and a foreground element.

The coefficients used for the mixing are derived from tables whose selection is effected through the field of the layer C1 which occupies the foreground. This table is addressed by the value of the parameter alpha of the current pixel of the layer C1 of the foreground. It provides a pair of coefficients which are used by the multipliers of the mixer, at output the following is obtained:

$$Rout=Cf*Rf+Cb*Rb$$

$$Gout=Cf*Gf+Cb*Gb$$

$$Bout=Cf*Bf+Cb*Bb$$

Rf, Gf, Bf are the RGB components of the foreground, Rb, Gb, Bb are those of the background, Cf and Cb being the mixing coefficients.

The coefficients are coded on 9 bits, the value 256 representing unity. They will preferably be chosen in such a way that their sum does not exceed this value so as to avoid colorimetric artefacts. The transparency effects are controlled entirely by the value of these coefficients, the output of the mixer being able to take all the values between that of the background (Cf=0) and that of the foreground (Cb=0).

A saturation device is implemented at each stage of the means MIX making it possible to mix the intermediate pixels of each layer C1 to C4 so as to prevent a situation in which the use of coefficients whose sum exceeds unity would lead to the creation of an erroneous image where colour inversion would occur, in the case of saturation the image will tend towards white.

The mixer also evaluates the opacity value alpha which must be associated with the colorimetric values, here the choice has been made to use the maximum function, we then have:

$$A\text{out}=\max(Af,Ab)$$

This guarantees that an element of maximum opacity (A=1) remains so whatever layer it belongs to, this being essential if it is desired subsequently to mix the image thus obtained with a video background without this background modifying.

The identifier of the foreground surface is also provided accompanied with the attributes pertaining to the choices of video and of cursor which are managed by ancillary circuits. These quantities are placed at the disposal of the users so as to drive cursor generation and or a mixer stage managing one or more external videos.

The functional means described in the figure are implemented on an electronic component with logic gates of FPGA or ASIC type for example. The logic schema implemented with this type of component in order to execute the SELECT, REQ, ASSEMBLE and MIX functions of the device is not a limitation of the scope of the invention. The person skilled in the art is also aware of how to use any other component making it possible to execute the same functions and consequently the choice of the electronic components making it possible to implement these functions is not a limitation to the scope of the invention.

The invention is intended more particularly for display devices in respect of visual display units situated onboard mobile craft and constrained in terms of resources and reliability. More generally, graphical generation devices for any type of visual display unit are relevant.

We claim:

1. A display device for displaying an image, pixels in the display device being displayed at a predetermined frequency of display, the display device comprising:

a device for generating the image by generating pixels of the image the device for generating the image configured to generate a plurality of information windows that can be displayed superimposed, the image including mixed pixels whose value corresponds to a mixture of n superimposed layers of intermediate pixels from among m superimposed layers, with m being greater than n, an information window being supported by a layer of intermediate pixels and being parametrized by a window descriptor, the intermediate pixels being recorded in an image memory by a destructuring of each line of the layer of intermediate pixels by different latencies to store segments of the image at distinct memory addresses, the device for generating the image comprising at least one electronic component with logic gates, the at least one electronic component implementing:

a selection of n intermediate pixels belonging to n active windows from among the plurality of windows for each mixed pixel of the said image to be generated and a recording of at least the following parameters arising from the window descriptor for each intermediate pixel selected: a layer identifier, an attribute and a value of the memory address within the image memory, a generation of a list of commands for access to at least one memory area of the image memory for a segment of the selected intermediate pixels, the memory addresses of said selected intermediate pixels being contiguous, a recordation of n composite lines of intermediate pixels, a composite line including a plurality of segments of the selected intermediate pixels originating from distinct layers of said mixed pixels of the image memory, a mixer configured to carry out a mixing of the values of the n selected intermediate pixels originating from the said composite lines of the intermediate pixels, said mixer configured to perform said mixing by deriving coefficients for a line in the n intermediate pixels from a table and using said coefficients as multipliers for RGB components in a foreground and a background of the image; and a reconstruction of the image by collecting pixels by using a reduced number of layers of intermediate pixels than the intermediate pixels recorded for displaying on the display device.

2. The device according to claim 1, wherein the selection of the n intermediate pixels comprises, as a selection criterion, an opacity coefficient of the intermediate pixels of upper layers that are above a particular intermediate layer.

3. The device according to claim 1, wherein a size of the segment of the selected intermediate pixels is a multiple of a size for reading image memory data in a burst mode such that the selected intermediate pixels are read from the image memory data in blocks that do not exceed a capacity of the burst mode.

4. The device according to claim 1, wherein the number n is configurable.

5. The device according to claim 1, wherein the number m configurable.

6. The device according to claim 1, wherein the logic gates are implemented in a circuit of FPGA type or a circuit of ASIC type.

7. A method for displaying an image, comprising:

generating an image by generating pixels of the image, the image having a plurality of information windows displayable in a superimposed manner, the image including mixed pixels whose value is corresponds to a mixture of n superimposed layers of intermediate pixels from among m superimposed layers, with m being greater than n, an information window being supported by a layer of intermediate pixels and being parametrized by a window descriptor, the intermediate pixels being recorded in an image memory by a destructuring of each line of the layer of intermediate pixels by different latencies to store segments of the image at distinct memory addresses, the method comprising the steps of:

selecting the intermediate pixels of the active windows from among the m superimposed layers, storing parameters of the selected intermediate pixels: a layer identifier, an attribute and a value of a memory address in the image memory, generating an access command for a segment of the selected intermediate pixels, recording a list of access commands for segments of the selected intermediate pixels constituting a line of the selected intermediate pixels, recording the line of selected intermediate pixels including a plurality of said segments, said line comprising the intermediate pixels originating from distinct layers of mixed pixels, mixing the selected intermediate pixels of said recorded lines for a composition of the mixed pixels of the image by deriving coefficients for a line in the n intermediate pixels from a table and using said coefficients as multipliers for RGB components in a foreground and a background of the image; and reconstructing the image by collecting pixels by using a reduced number of layers of intermediate pixels than the intermediate pixels recorded for displaying on a display device.

8. The method according to claim 7, wherein the access command is an access in a burst mode.

9. The method according to claim 7, wherein, in the step of selecting, the intermediate pixels of the active windows positioned on a layer lower than an intermediate pixel having a maximum opacity coefficient are not selected.

* * * * *